United States Patent [19]

Krause et al.

[11] 4,115,309

[45] Sep. 19, 1978

[54] COMPOSITIONS AND METHOD FOR ACTIVATING OXYGEN UTILIZING CYCLIC ESTER-ANHYDRIDES OF α-HYDROXYCARBOXYLIC ACIDS

[75] Inventors: Horst-Jürgen Krause, Dusseldorf-Holthausen; Christian Hase, Erkrath-Unterbach; Helmut Bloching, Hilden, all of Fed. Rep. of Germany

[73] Assignee: Henkel Kommanditgesellschaft auf Aktien, Dusseldorf-Holthausen, Fed. Rep. of Germany

[21] Appl. No.: 782,335

[22] Filed: Mar. 29, 1977

[30] Foreign Application Priority Data

Apr. 3, 1976 [DE] Fed. Rep. of Germany ..... 2614521

[51] Int. Cl.[2] ..... C11D 7/54

[52] U.S. Cl. ..... 252/186; 8/111; 252/96

[58] Field of Search ..... 252/186, 95, 99; 8/111

[56] References Cited

U.S. PATENT DOCUMENTS

| | | | |
|---|---|---|---|
| 3,423,430 | 1/1969 | Cahn et al. | 252/99 |
| 3,697,432 | 10/1972 | Maulding | 252/186 |
| 3,909,438 | 9/1975 | Nakagawa et al. | 252/186 |
| 3,919,102 | 11/1975 | Kuhling et al. | 252/186 |
| 3,960,743 | 6/1976 | Nakagawa et al. | 252/186 |

FOREIGN PATENT DOCUMENTS 1,485,302 5/1967 France.

*Primary Examiner*—Benjamin R. Padgett
*Assistant Examiner*—Deborah L. Kyle
*Attorney, Agent, or Firm*—Hammond & Littell

[57] ABSTRACT

The method of activating aqueous solutions of percompounds utilizing hexacyclic ester-anhydrides of α-hydroxycarboxylic acids of the formula

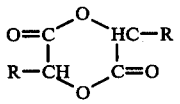

as activators, solid activated compositions comprising solid percompounds and said cyclic ester-anhydrides of α-hydroxycarboxylic acids, as activators.

16 Claims, No Drawings

COMPOSITIONS AND METHOD FOR ACTIVATING OXYGEN UTILIZING CYCLIC ESTER-ANHYDRIDES OF α-HYDROXYCARBOXYLIC ACIDS

Related Art

It is common knowledge that inorganic peroxides, particularly hydrogen peroxide and peroxide hydrates, such as perborate, percarbonate and perpyrophosphate, develop their full oxidation and bleaching action in aqueous solution only at temperatures in excess of 80° C. In order to obtain an adequate bleaching action even at lower temperatures, it has been proposed to add specific N-acyl compounds to the aqueous solutions of percompounds in order to activate the latter. According to German Published Application DAS No. 1,162,967, the compounds used for this purpose should contain at least two acyl groups attached to the same nitrogen atom, such as N,N,N'-triacetylmethylenediamine, N,N,N',N'-tetraacetylmethylenediamine and the like. According to German Published Application DAS No. 1,291,317, compounds of the general formula $$RCO - NR_2 - OCR_1$$

serve this purpose, wherein R and $R_1$ signify $C_{1-3}$ alkyl residues, while $R_2$ may constitute an optional organic radical which may be combined with $R_1$ to form a ring, if desired substituted, such as caprolactam, N-acylated barbitone, phthalimide, anthranil, N-acylated hydantoin or saccharine rings. U.S. Pat. No. 3,715,184, described the use of acylated glycolurils of the general formula

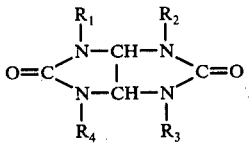

wherein at least two of the residues $R_1$ and $R_4$ constitute acyl residues having 2 to 8 carbon atoms, while the other residues signify hydrogen atoms and/or alkyl or aryl residues having 1 to 8 carbon atoms and/or acyl residues having 2 to 8 carbon atoms, as activators for percompounds. The acyl residues present in one molecule may be the same or different. Preferably, tetraacylglycolurils having similar $C_{2-4}$ acyl residues are used, particularly tetraacetylglycoluril.

It has also been proposed, in German Auslegeschrift (DAS) 2,360,340, to use oxamides of the formula $$R - NH - CO - CO - NH - R'$$

in which R and R' represent acyl radicals having 2 to 9 carbon atoms as bleaching activators. These oxamides are said to be distinguished by improved storage stability in the presence of peroxide. However, a substantial disadvantage of the described oxamides is their relatively very low activation value. Thus, in order to obtain adequate activation, very large quantities of bleaching activators have to be used, only a slight cold-bleaching action being obtainable when using quantities which meet practical requirements.

The acylated nitrogen compounds hydrolyze in the presence of aqueous hydrogen peroxiide to form peracids which develop a satisfactory bleaching and disinfecting action even in the range of temperature between 30° C and 60° C. However, owing to their nitrogen content, acylated imides can cause undesirable eutrophication of waters which are heavily loaded with waste water, so that it may be advantageous to use bleaching activators which are free from nitrogen. Nitrogen-free bleaching activators are also known, such as acid anhydrides in accordance with German Patent Specification 893,049 and German Published application (DAS) 1,038,693, or esters of phenols or polyvalent alcohols in accordance with German Pat. Specifications 1,246,658 and 1,227,179. However, it has transpired that the bleaching effects obtainable by means of these compounds are relatively slight.

Therefore, the task arose of providing new oxidation, bleaching and washing agents having a content of bleaching activators which do not have the aforesaid disadvantages.

OBJECTS OF THE INVENTION

An object of the present invention is to develop solid compositions with bleaches and bleach activators which do not contain nitrogen atoms.

Another object of the present invention is the development of solid oxidation compositions for washing and bleaching agents containing compounds releasing active oxygen in solution and at least one hexacyclic ester anhydride having the formula

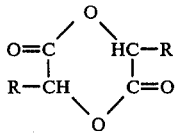

wherein R is a member selected from the group consisting of hydrogen, alkyl having 1 to 18 carbon atoms and $-(CH_2)_n-(CHOH)_m-COOY$, where n is an integer from 1 to 3, m is an integer from 0 to 1 and Y is a member selected from the group consisting of hydrogen, alkali metal, ammonium, lower alkanolammonium, and N-lower-alkyl-piperidinium.

A further object of the present invention is the development of a method of activating aqueous solutions of percompounds at temperatures below 70° C by utilization of said hexacyyclic ester - anhydride described above.

These and other objects of the present invention will become more apparent as the description thereof proceeds.

DESCRIPTION OF THE INVENTION

Accordingly, the present invention provides oxidation, bleaching and washing agents comprising inorganic percompounds and a 6-member cyclic ester - anhydride of an α-hydroxy-carboxylic acid or an α-hydroxydicarboxylic acid.

Suitable 6-member cyclic ester-anhydrides are those of Formula I:

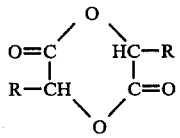

I in which R represents H or an alkyl radical having 1 to 18 carbon atoms or a radical of the formula:

$$-(CH_2)_{n-(CHOH)m}-COOY$$

in which Y = H, Na, K, $NH_4$, or the cation of an organic ammonium base such as mono-, di-and triethanolamine, or N-methylpiperidine, $n$ = 1, 2 or 3 and $m$ = 0 or 1. Preferably, Y represents Na or K.

More particularly, the present invention relates to solid powdery-to-granular oxidation compositions for bleaching and washing agents consisting essentially of a water-soluble solid inorganic percompound in the form of its alkali metal salt and at least one hexacyclic ester-anhydride having the formula

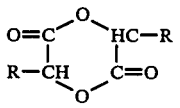

wherein R is a member selected from the group consisting of hydrogen, alkyl having 1 to 18 carbon atoms and $$-CH_2)_n-(CHOH)_m-COOY,$$

where $n$ is an integer from 1 to 3, m is an integer from 0 to 1, and Y is a member selected from the group consisting of hydrogen, alkali metal, ammonium, lower alkanolammonium, and N-lower-alkyl-piperidinium, as an activator, said activator being present in an amount sufficient that from 0.05 to 5 mols of said activator are present per mol of active oxygen atoms in said percompound.

Examples of suitable cyclic ester-anhydrides are: diglycolide (2,5-dioxo-1,4-dioxan) and dilactide (3,6-dioxo-2,5-dimethyl-1,4-dioxan), the dimeric lactones of α-hydroxybutyric acid, α-hydroxyvaleric acid, α-hydroxycaproic acid, α-hydroxylauric acid, α-hydroxymyristic acid, α-hydroxypalmitic acid, α-hydroxystearic acid, malic acid, α-hydroxyglutaric acid, α-hydroxyadipic acid and 2,5-dihydroxyadipic acid. Preferably, diglycolide and dilactide are used.

The fact that the said cyclic ester-anhydrides cause the bleaching activation of inorganic peroxides is highly unexpected, since they do not produce any measurable effect under the conditions in which the activation value is normally determined. It is common knowledge that the activation value is determined with hydrogen peroxide in the presence of an alkali reacting phosphate-borate buffer at α° C, wherein the peracid formed oxidized iodide to form free iodine which is back-titrated with sodium thiosulfate (see German Patent Specification 1,246,658). Hitherto, a positive reaction during the performing of this test was a prerequisite for the suitability of the relevant compound as a bleaching activator.

Although the cyclic ester-anhydrides, to be used in accordance with the invention, do not react positive during this test, they exhibit, in use, for example, when bleaching colored dirt on textiles, a marked improvement in the bleaching effect at low temperatures. Since the cyclic ester-anhydrides are free from aromatic radicals, they are also very readily and fully decomposable in waste water. Furthermore, cyclic ester-anhydrides, derived from α-hydroxy acids having 12 to 20 carbon atoms, have the advantage that they have washing-active properties after perhydrolysis and reconversion to the salts of α-hydroxy acids, and can improve the cleaning power of the agents.

The cyclic ester-anhydrides can be added to the oxidation, bleaching and cleaning agents or solutions immediatelly before use or, alternatively, they can be incorporated in the pulverulent or granular washing and bleaching agents and used together therewith. The present invention, therefore, relates to the use of the above-described ester-anhydrides as activators for $H_2O_2$ or percompounds producing $H_2O_2$ in water.

The percompounds to be activated in aqueous solution can be any type of inorganic or organic percompound which will release active oxygen in an aqueous solution. For economic reasons, the percompounds preferably utilized are inorganic peroxides, inorganic peracids, inorganic peroxyhydrates and products of the addition of hydrogen peroxide with inorganic and organic compounds.

Of the peroxides to be activated, hydrogen peroxide is of the greatest practical importance. It may be used as such, but may also be used in the form of its mostly solid peroxyhydrates or products of addition with inorganic and organic compounds. The latter include, for example, the products of addition of hydrogen peroxide to urea or melamine, and examples of the peroxyhydrates are the perborates, perortho-, perpyro-, and perpolyphosphates, percarbontes, and persilicates. These peroxyhydrates are preferably soluble in water and are ordinarily utilized in the form of their alkali metal salts, such as their sodium salts. The activators, according to the invention, however, may also be used together with true peracids, such as, for example, Caro's acid (peroxymonosulfuric acid, $H_2SO_5$) or peroxydisulfuric acid ($H_2S_2O_8$) or their salts.

The activation, in accordance with the invention, of the oxygen is most clearly perceptible at temperatures in the range of 20° to 70° C, especially from 30° to 60° C. Nevertheless, it is possible to use higher temperatures up to 100° C, for example, particularly when using deficient quantities of activator, so that chemically activated oxygen is used at temperatures up to 70° C and thermally activated oxygen at higher temnperatures, particularly temperatures in excess of 80° C. Depending upon the problem to be solved, it is possible for the technician, when using the activators according to the invention, either to reduce the temperature of treatment and/or to shorten the time of treatment, the temperature remaining the same.

Finally, a low and a high temperature bleach can also be combined in one operation. In such cases, it may be advantageous to add less than the theoretical amounts of activator, then at low temperatues only a part of the active oxygen present is activated, and the remainder is available for the bleaching at elevated temperatures.

The conditions to be maintained during operation with the activators according to the invention, such as, for example, the concentration of the peroxide, temperature, pH value and time of treatment, depend substantially on the substance to be oxidized and/or bleached, and in some cases on the carrier material on or in which the substance to be bleached is present. The usually aqueoua oxidizing or bleaching liquids may contain from 20 to 500 mg, preferably from 50 to 250 mg, per liter of active oxygen and have a pH value of from 4 to 12, preferably from 7 to 11.5, and particularly from 8 to 11.

In addition to inorganic percompounds, such as sodium perborate in the form of mono or tetrahydrate, percarbonate, perpyrophosphate or urea perhydrate, such washing and bleaching agents can contain further conventional washing-active substances, such as surfactants, was alkalis, sequestering which bind calcium salts, and other builders as well as further additives conventionally contained in washing and cleaning agents.

Advantageously, the compounded agents contain the cyclic ester-anhydrides and the percompounds in the ratio of 0.2 to 20, preferably 0.5 to 10, mol of peroxygen to 1 mol of cyclic ester-anhydride.

Furthermore, the joint use of alkaline reacting compounds, such as compounds of alkali metal carbonates, bicarbonates, borates, silicates and phosphates or condensed alkli metal phosphates, is advisable in quantities such that the carboxylic acid, released during the bleaching process, is fully or at least partially neutralized.

Suitable surface-active compounds or tensides are those of the sulfonate or sulfate type, such as alkylbenzene sulfonates, particularly n-dodecylbenzene sulfonate, olefinsulfonates, alkylsulfonates and α-sulfo-fatty acid esters, primary and secondary alkyl sulfates, as well as the sulfates of ethoxylated or propoxylated fatty alcohols. The sulfated partial ethers and partial esters of polyhydric alcohols are also usable, such as the alkali salts of mono-higher-alkyl ether or of mono-higher-fatty acid ester of glycerol-monosulfuric acid ester or of 1,2-dioxypropane sulfonic acid. Sulfates of ethoxylated or propoxylated fatty acid amides and alkylphenols, as well as fatty acid taurides and fatty acid isothionates are also suitable.

Further suitable anionic surface-active compounds are alkali metal soaps of fatty acids of natural or synthetic origin, such as sodium soaps of coconut fatty acids, palm kernal fatty acids, or tallow fatty acids. Suitable zwitterionic surface-active compounds are the alkylbetaines and partichularly alkylsulfobetaines, such as 3-(N,N-dimethyl-N-higher-alkylammonium)-propane-1-sulfonate and 3-(N,N-dimethyl-N-higher-alkylammonium)-2-hydroxypropane-1-sulfonate.

The anionic surface-active compound may be present in the form of their alkali metal salts, such as sodium or potassium, and ammonium salts as well as salts of organic bases, such as mono-, di- or triethanolamine. Insofar as the said anionic and zwitterionic surface-active compounds have an aliphatic hydrocarbon radical, the latter should be preferably straight chain and have 8 to 22 carbon atoms. In the compounds having an aliphatic hydrocarbon radical, the preferably unbranched alkyl chains contain an average of 6 to 16 carbon atoms. The aryl hydrocarbon radical is cyclohexyl or preferably phenyl.

Suitable nonionic surface-active compounds or tensides are those of the class of the polyglycolether derivatives, such as those of alcohols having 10 to 24 carbon atoms from the group of alkanols, alkenols and alkanediols and/or alkylphenols having 6 to 15 carbon atoms in the alkyl chain and 3 to 30 alkoxy units. The alkoxy units are propoxy or preferably ethoxy and mixtures of propoxy and ethoxy units. Mixtures of such polyglycolether derivatives are particularly suitable in which at least one compound having 3 to 6 ethoxhy units and at least one compound having 7 to 20 ethoxy units are present in the weight ratio of 5:1 to 1:10. Preferably polyglycolether derivatives of straight chain, primary alkanols having 12 to 18 carbon atoms, and of alkylphenols having straight chain alkyl chains having 8 to 12 carbon atoms, are used.

Further suitable nonionic surface-active compounds are the glycolether derivatives of higher fatty acids, higher fatty acid amides, primary or secondary higher fatty amines, vicinal higher alkane diols, higher alkyl mercaptans and alkyl sulfamides which have 10 to 24 carbon atoms in the hydrocarbon radical and 3 to 30 glycolether groups, preferably ethoxy units. Nonionic surface-active compounds of the type of aminoxides and sulfoxides, which may be optionally ethoxylated, are also usable.

Suitable builders are the alkali metal carbonates and silicates, such as potassium and particularly of sodium, the latter having a ratio of $SiO_2$ to $Na_2O$ of 1:1 to 3.5:1. Suitable builders having a sequestering action are polymeric phosphates, particularly pentasodium tripolyphosphate which may be present mixed with its products of hydrolysis, the mono- and diphosphates, as well as higher condensed phosphates such as tetrapoluphosphates.

Alternatively, the polymeric phosphates can be entirely or partially replaced by phosphate-free sequestering agents. These include the alkali metal salts of aminopolycarboxylic acids, particularly nitrilotriacetic acid and ethylenediaminotetraacetic acid. Also suitable are the salts of diethylenetriaminopentaacetic acid as well as the higher homologues of the said aminopolycarboxylic acids. Further suitable aminopolycarboxylic acids are poly-(N-succinic acid)-ethylene imine, poly-(N-tricarballylic acid)-ethylene imine and poly-(N-butane-2,3,4-tricarboxylic acid)-ethylene imine.

The salts of aminopolycarboxylic acids can be replaced by, or mixed with, polyphopshonic acids having a sequestering action, such as alkali metal salts of aminopolyphosphonic acids, particularly amino-tri-(methylene phosphonic acid), 1-hydroxyethane-1,1-diphosphonic acid, methylene diphosphonic acid, ethylene diphosphonic acid as well as salts of the higher homologues of the said polyphosphobic acids.

Particular importance is attached to the nitrogen and phosphorus-free polycarboxylic acids forming complex salts with calcium ions, including polymers containing carboxyl groups. Citric acid, tartaric acid, benzenehexacarboxylic acid and tetrahydrofurantetracarboxylic acid are also suitable. Polycarboxylic acids contaning carboxy methyl ether groups are also usable, such as 2,2'-oxydisuccinic acid as well as polyvalent alcohols or hydrocarboxylic acids partially or fully etherified with glycolic acid, such as triscarboxymethyl glycerine, biscarboxymethyl glyceric acid and carboxymethylated or oxidized poly saccharides. Also suitable are the polymeric carboxylic acids having a molecular weight of at least 350 in the form of water-soluble sodium or potassium salts, such as polyacrylic acid, polymethacrylic acid, poly α-hydroxyacrylic acid, polymaleic acid, polyitaconic acid, polymesaconic acid, polybutenetricarboxylic acid, as well as the copolymers of the corresponding monomeric carboxylic acids one with another or with ethylenically-unsaturated compounds such as ethylene, propylene, isobutylene, vinylmethyl ether or furan.

Water-insoluble complex formers may also be used. These include phosphorylated cellulose and graft polymers of acrylic acid or methacrylic acid or cellulose, which can be present in the form of textile fabric, nonwoven fabric or powder. Also suitable are spatially cross-linked and thus water-insoluble copolymers of acrylic acid, methacrylic acid, crotonic acid and maleic acid as other polymerizable polycarboxylic acids optionally with further ethylenically-unsaturated compounds in the form of sodium or potassium salts as sequestering agents. These insoluble copolymers can be in the form of fleeces, sponges, or alternatively, in the form of finely-ground foams having a low specific gravity and an open-cell structure.

Further suitable water-insoluble builders having a sequestering capability are alkali metal amuminosilicates which optionally contain bound water and in which the alkali metal can be exchanged for calcium or magnesium. These substances include, particularly, finely crystalline-to-amorphous aluminosilicates of the formula $$(Na_2O)_x \cdot Al_2O_3 \cdot (SiO_2)_y$$

wherein $x$ represents a number of from 0.7 to 1.5, and y represents a number of from 1.3 to 4. The use of these aluminosilicates as builders is described in copending U.S. patent application Ser. No. 458,306, filed Apr. 5, 1974, now abandoned in favor of its continuation Ser. No. 800,308, filed May 25, 1977. Alternatively, mixtures of the aforesaid water-soluble and water-insoluble builder or complex formers can be used.

Magnesium silicate is particularly suitable as a stabilizer for the percompounds. Furthermore, enzymes from the class of the proteases, amylases and lipases may be present, particularly bacterial enzymes, such as those obtained from Bacillus subtilis.

Furthermore, the washing agents can contain optical brighteners, particularly derivatives of diaminostilbene disulfonic acids or their alkali metal salts. Salts of 4,4'-bis(2''-anilino-4''-morpholino-1,3,5-triazinyl-6''-amino)-stilbene-2,2'-disulfonic acid, for example, are suitable or similar compounds which contain, instead of the morpholino group, a diethanolamino group, a methylamino group, or a $\beta$-methoxyethylamino group. Furthermore, suitable optical brighteners for polyamide fibers are those of the diarylpyrazoline type, such as 1-(p-sulfonamidophenyl)-3-(p-chlorophenyl)-$\Delta^2$ -pyrazoline, as well as similar compounds which contain a carboxymethyl or acetylamino group instead of the sulfonamido group. Furthermore, substitued aminocumarins are usable, such as 4-methyl-7-dimethylamino-cumarin or 4-methy-7-diethylamino-cumarin.

In addition, the compounds 1-(2-benzimidazolyl)-2-(1-hydroxyethyl-2-benzimidazolyl)-ethylene and 1-ethyl-3-phenyl-7-diethyolamino-carbostyril are usable as polyamide brighteners. Suitable optical brighteners for polyester and polyamide fibers are the compounds 2,5-di-(2-benzoxazolyl)-thiophene, 2-(2-benzoxazolyl)-naphtho-[2,3-b]-thiophene and 1,2-di-(5-methyl-2-benzoxazolyl)-ethylene. Furthermore, optical brighteners of the substituted diphenylstyril type may be present. Mixtures of the aforesaid optical brighteners may also be used.

Particularly suitable greying inhibitors or soil suspension agents are carboxymethylcellulose, methylcellulose, water-soluble polyesters and polyamides from polyvalent carboxylic acids and glycols or diamines which have free carboxyl groups, betaine groups or sulfobetaine groups capable of forming salts, as well as polymers or copolymers which are colloidally soluble in water, of vinyl alcohol, vinyl pyrrolicone, acrylamide and acrylonitrile.

Further suitable constituents are neutral salts, particularly sodium sulfate, as well as biocides or antimicrobials, such as halogenated diphenylmethanes, salicylanilides, carbanilides and phenols. Furthermore, liquid agents can contain hydrotropic substances and solvents, such as alkali metal salts of benzene sulfonic acid, toluene sulfonic acid or xylene sulfonic acid, urea, glycerine, polyglycerine, deithyleneglycol, or triethyleneglycol, polyethyleneglycol, ethanol, i-propanol, and other ether alcohols.

If required, known foam stabilizers, such as fatty acid alkanolamides, may also be present, such as laurylmonoethanolamide or diethanolamide or coconut fatty acid mono- or diisopropanolamides.

The cyclic ester-anhydrides to be used in accordance with the invention may be mixed with the pulverulent bleaching and washing agents, containing inorganic percompounds, without special precautions, since, even without a protective coating, they have adequate storage stability when stored under normal conditions. It is only in those cases in which it is impossible to avoid longer storage times at temperatures in excess of 25° to 30° C and high relative atmospheric humidity that it may be advisable to store the bleaching activators separately from the washing and bleaching agents containing persalt or to provide them with a protective coating of water-repellent materials or to embed them therein.

Examples of such cases of application are tablets which contain, in addition to the bleaching activator, conventional tabletting agents, such as starch, starch ether, microcrystalline or depolymerized cellulose, cellulose ether or swellable magnesium aluminum silicates ("Veegum", registered trademark), and alkali earth metal soaps, particularly magnesium stearate, as well as finely powdered mineral parting agents, particularly colloidal $SiO_2$ ("Aerosil", registered trademark) and, if required, surface-active wetting agents which promote the wetting and dissolving capacity. It will be appreciated that, alternatively, tablets of this type may be composed such that they contain the bleaching activator as well as the inorganic percompound (both of them preferably in a pregranulated form) and, optionally, further constituents of washing agents. In this case, the tabletting agent at the same time acts as a parting agent between the reactants.

A further embodiment suitable for particularly unfavorable storage conditions is the embedding of the bleaching activators in so-called "prills", i.e., loose powders which are producible by spraying a molten mass with simultaneous cooling of the material sprayed and which substantially comprise spherical individual particles having a diameter of approximately 0.1 to 2.5 mm. Embedding materials which have proved to be successful are, in particular, mixtures of insoluble fat-like compounds, particularly fatty acid mixtures and/or fatty alcohols melting between 35° and 60° C, as well as water-soluble, plasticizable compounds such as polyethyleneglycols and/or polyethyleneglycol ethers of fatty alcohols, alkylphenols, fatty acids, fatty acid amides, diols and other water-soluble polyglycol ether derivatives. By way of example, the weight ratio of water-insoluble to water-soluble embedding components can be 5:1 to 1:1. In addition, it is also possible to incorporate cellulose or starch ethers or "disintegrating agents" having a similar action and which are swellable in water and promote the dissolving capacity. The prills can be directly incorporated in the pulverulent oxidation, bleaching and washing agents. Such embedding processes are described in U.S. Pat. No. 4,003,841.

The cyclic ester-anhydrides can also be used to advantage in polishing and scouring agents. In addition to the inorganic peroxides and, if required, tensides and builders, these polishing and scouring agents can also contain abrasives such as pumice powder, marble powder, feldspar or quartz powder, corundum, synthetic resin granulates, steel cuttings or mixtures of such abrasives. The polishing and scouring agents may be present in the form of powder, rods or cubes or, alternatively, in a liquid form or in polishing pads based on steel wool or plastic wool which are impregnated with effective cleaning and bleaching substances.

Further fields of application for the cyclic and mixtures thereof with organic peroxides are washing agents for agents for automatic dishwashers, disinfectants and deodorizing preparations for the santiary and clinical field where they may be used in, for example, toilet and and drain cleaners, for disinfecting swimming pools and for the sterilizing or medical instruments and infected articles, as well as the food and beverage industry, for example, as an additive to alkaline cleaners for bottles and milk cans and in so-called beer coils, for sterilizing the water used for washing beer glasses in restaurants. They are also suitable for disinfecting the body and for the bleaching of human hair or, alternatively, for brightening chemical compounds. Basically, it is possible to use them in all fields in which agents containing active chlorine are customarily used and in which the aggressive properties and the unpleasant odor of chlorine are troublesome.

The oxidation, bleaching and washing agents generally contain the cyclic ester-anhydrides in quantities of from 0.5% to 50%, preferably from 1% to 30%, by weight. Some basic formulations for bleaching, washing and cleaning agents, in which the cyclic ester-anhydrides have proved to be successful, are given hereinafter. However, the range of application is not confined to these formulations.

FORMULATIONS

A. Washing Agent

5% to 40%, preferably 12% to 30%, by weight of tensides or combinations of tensides, comprising:

- 0 to 100%, preferably 25% to 65%, by weight of anionic tensides of the sulfonate and/or sulfate type,
- 1% to 100%, preferably 5% to 40%, by weight of nonionic tensides,
- 0 to 100%, preferably 10% to 50%, by weight of soap,
- 0 to 6%, preferably 0.5% to 3%, by weight of foam stabilizer,
- 0 to 8%, preferably 0.5% to 5%, by weight of foam inhibitor, 10% to 82%, preferably 35% to 75%, by weight of builders wherein at least a portion of these builders react alkaline, and wherein the amount of the alkaline to neutral reacting builders amounts preferably to 0.5-fold to 7-fold, and particularly 1-fold to 5-fold the total tenside component, 10% to 50%, preferably 15% to 35%, by weight of a combination of percompound, particularly perborate and cyclic ester-anhydrides and, if required, stabilizers for the percompound, the quantity of this combination preferably being such that the active oxygen content of the total bleaching and washing agent amounts to 1% to 4%, preferably 1.5% to 3.5% by weight.

0 to 15%, preferably 1% to 12%, by weight of other washing agent constituents, such as oil suspension agents, optical brighteners, enzymes, perfume, dyes, and water.

B. Scouring Agent

60% to 95%, preferably 80% to 90%, by weight of water-insoluble constituents having a scouring action.

40% to 5%, preferably 20% to 10%, by weight of an essentially water-soluble mixture comprising:

- 5% to 100%, preferably 10% to 50%, by weight of a combination of percompound and cyclic ester-anhydrides, the quantity ratio of percompound to activator lying in the range given above,
- 0 to 95%, preferably 10% to 60%, by weight of anionic, nonionic and/or zwitterionic tensides,
- 0 to 95%, preferably 10% to 50%, by weight of particularly alkaline reacting inorganic builders and organic complex formers,
- 0 to 20%, preferably 1 to 10%, by weight of other conventional constituents of scouring agents.

C. Agent for Dishwashing Machines 0 to 5%, preferably 0.1% to 3%, by weight of a low-foaming tenside, particularly a nonionic surface-active compound from the class of the block polymers of ethylene oxide and propylene oxide, 30% to 98%, preferably 40% to 95%, by weight of builders, wherein at least a portion of these builders reacts alkaline and is preferably composed of the following:

- 20% to 100% by weight of Na or K tripolyphosphate,
- 0 to 90% by weight of a water-insoluble, cation-exchanging sodium aluminosilicate,
- 0 to 50%, preferably 5% to 50%, by weight of sodium silicate ($Na_2O : SiO_2 = 1:1$ to $1:3.5$), 0.1% to 50%, preferably 0.5% to 10%, by weight of a combination comprising an inorganic percompound, particularly perborate and cyclic ester-anhydrides and, if required, stabilizers for the percompound, the quantity ratio of activator to percompound corresponding to the range given above.

D. Alkaline Cleaner

50% to 99% by weight of at least one alkaline-reacting compound from the class of the sodium or potassium hydroxides, carbonates, phosphates, polymeric phosphates, borates and silicates ($Na_2O : SiO_2 = 2:1$ to $1:3$), 0 to 20%, preferably 0.1% to 10%, by weight of at least one sequestering agent from the class of the aminopolyphosphonates and hydroxyalkanepolyphosphonates, 0 to 5%, preferably 0.1% to 3%, by weight of at least one nonionic and/or anionic surfactant, 0.1% to 20%, preferably 0.2% to 10% by weight of a combination of inorganic percompound, particularly perborate, and cyclic ester-anhydrides and, if required, stabilizers for the percompound, the quantity ratio of activator to percompound corresponding to the range given above.

E. Bleaching Agent

10% to 100%, preferably 50% to 95%, by weight of a combination of inorganic percompound, particularly perborate and cyclic lactones and, if required, stabilizers for the percompound, the quantity ratio of activator to percompound corresponding to the range given above, 0 to 50%, preferably 2% to 25%, by weight of at least one alkaline-reacting compound from the class of the sodium or potassium hydroxides, carbonates, phosphates, polymeric phosphates, borates and silicates ($Na_2O : SiO_2 = 2:1$ to 1:3), 0 to 20%, preferably 0.1% to 10%, by weight of at least one sequestering agent from the class of the aminopolycarboxylates, aminopolyphosphonates and hydroxyalkanepolyphosphonates, 0 to 20%, preferably 0.1% to 10%, by weight of other constituents, such as corrosion inhibitors, optical brighteners and neutral salts.

Sodium perborate tetrahydrate ($NaBO2 . H_2O_2 . 3H_2O$) has particular practical important among the preferably inorganic percompounds yielding $H_2O_2$ in aqueous solution. Partially or completely dehydrated perborates, i.e., perborates dehydrated up to $NaBO_2 . H_2O_2$, may be used instead of sodium perborate tetrahydrate. Alternatively, the borates $NaBO_2 . H_2O_2$ (as described in German Patent No. 901,287 or in U.S. Pat. No. 2,491,789) may be used in which the ratio $Na_2O : B_2O_3$ is less than 0.5:1 and preferably from 0.4 to 0.15:1, while the ratio $H_2O_2$ : Na is from 0.5 to 4:1. All these perborates may be replaced entirely or partially by other inorganic percompounds, particularly by peroxyhydrates, for example, the peroxyhydrates of the ortho-, pyro- or polyphosphates, particularly tripolyphosphates, and of the carbonates. These peroxyhydrates are preferably soluble in water and are ordinarily utilized in the form of their alkali metal salts, such as the sodium salts.

It is advisable to incorporate quantities of from 0.25% to 10% by weight or conventional water-soluble and/or water-insoluble stabilizers for stabilizing the percompounds in the products of the invention. The magnesium silicates of a ratio of $MgO:SiO_2 = 4:1$ to 1:4, preferably 2:1 to 1:2, and particularly 1:1, generally obtained by precipitation from aqueous solutions, are suitable as water-insoluble stabilizers for percompounds. These compounds, for example, amount to from 1% to 8%, preferably 2% to 7%, of the weight of the entire preparation. Other alkaline earth metal silicates, cadmium silicates or tin silicates of corresponding composition may be used instead of the magnesium silicates. Water-containing oxides of tin are also suitable as stabilizers. Stabilizers soluble in water, which may be present together with stabilizers insoluble in water, are the organic complex formers whose quantity can amount to 0.25% to 5%, preferably 0.5% to 2.5%, of the weight of the entire preparation.

The following examples are illustrative of the practice of the invention without being limitative in any respect.

EXAMPLES

Cotton textile samples were uniformly impregnated with a tea decoction, red wine and blackcurrent juice, and were then dried. The samples were washed in a laboratory washing machine (launderometer) with the use of the following spray-dried washing agent (data given in parts by weight).

8.5 n-dodecylbenzene sulfonate (Na salt)
3.5 sodium soap (coconut and tallow fatty acids 1:1)
4.0 fatty alcohol 10-fold ethoxylated ($C_{16-18}$ mixture, iodine number = 50)
40.0 pentasodiumtripolyphosphate
5.0 sodium silicate ($Na_2O : SiO_2 = 1:3.3$)
2.0 Mg silicate
1.5 carboxymethylcellulose
0.5 Na ethylenediaminetetraacetate
0.3 optical brightener
7.5 sodium sulfate
7.2 water The proportions of washing agent, percompound and activator are given in rhe following Table I. The treatment temperatures were 30° and 60° C, the liquor ratio (weight of textile to washing liquor in liters) 1:10, and the treatment lasted 15 minutes, whereupon the samples were rinsed three times with water and dried. The samples were evaluated photometrically (wavelength of the light 465 nm). The results are given in the following Table I.

TABLE I

| Example | Washing Agent | Sodium Perborate | Diglycolide | Tea | | Red Wine | | Blackcurrent Juice | |
|---|---|---|---|---|---|---|---|---|---|
| | | | | 30° C | 60° C | 30° C | 60° C | 30° C | 60° C |
| Initial | gm/l | gm/l | gm/l | % Remission | | | | | |
| value | — | — | — | 30.9 | | 35.7 | | 22.3 | |
| — | 4.5 | — | — | 46.2 | 57.5 | 52.9 | 55.4 | 55.2 | 60.6 |
| — | 4.5 | 0.5 | — | 50.2 | 61.8 | 53.6 | 58.5 | 55.9 | 62.4 |
| 1 | 4.5 | 0.5 | 0.75 | 52.1 | 62.1 | 60.9 | 69.2 | 57.4 | 65.2 |
| 2 | 4.5 | 0.5 | 1.0 | 54.2 | 62.4 | 62.6 | 69.9 | 60.2 | 66.6 |
| 3 | 4.5 | 0.5 | 1.25 | 57.6 | 63.2 | 64.0 | 70.6 | 60.9 | 67.1 |
| 4 | 4.5 | 0.5 | 1.50 | 59.0 | 63.2 | 66.1 | 71.0 | 61.9 | 67.4 |
| 5 | 4.5 | 0.5 | 1.75 | 59.2 | 63.6 | 66.9 | 72.5 | 61.4 | 67.7 |
| 6 | 4.5 | 0.5 | 2.00 | 59.4 | 64.1 | 68.2 | 72.5 | 63.5 | 67.2 |

The preceding specific embodiments are illustrative of the invention. It is to be understood, however, that other expedients disclosed herein or known to those skilled in the art, may be employed without departing from the spirit of the invention or the scope of the appended claims.

We claim:

1. The method of activating aqueous solutions of percompounds selected from the group consisting of hydrogen peroxide and water-soluble inorganic peroxyhydrates containing from 20 mg to 500 mg per liter of active oxygen, said solution having a pH of 4 to 12 and a temperature of from 10° to 70° C which consists essentially of adding to said aqueous solution at least one hexacyclic ester-anhydride having the formula

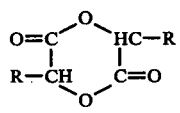

wherein R is a member selected from the group consisting of hydrogen, alkyl having 1 to 18 carbon atoms and $—(CH_2)_n—(CHOH)_m—COOY$, where n is an integer from 1 to 3, m is an integer from 0 to 1 and Y is a member selected from the group consisting of hydrogen, alkali metal, ammonium, lower alkanolammonium, and N-lower-alkyl-piperidinium, as an activator, in an amount sufficient to activate said percompound.

2. The method of claim 1, wherein said aqueous solution has a pH of from 6 to 11.5.

3. The method of claim 2, wherein said aqueous solution has a pH of from 8 to 11.

4. The method of claim 1, wherein said activator is added to said aqueous solution in an amount sufficient that from 0.1 to 2 mols of said activator are present per active oxygen atom in said aqueous solution.

5. The method of claim 1, wherein from 50 mg to 250 mg per liter of active oxygen are present in said aqueous solution.

6. Solid oxidation compositions for use with bleaching and washing agents consisting essentially of from 5% to 90% by weight of at least one hexacyclic ester-anhydride having the formula

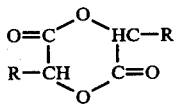

wherein R is a member selected from the group consisting of hydrogen, alkyl having 1 to 18 carbon atoms and $-(CH_2)_n-(CHOH)_m-COOY$, where $n$ is an integer from 1 to 3, $m$ is an integer from 0 to 1 and Y is a member selected from the group consisting of hydrogen, alkali metal, ammonium, lower alkanolammonium, and N-lower-alkyl-piperidinium, as an activator, from 95% to 10% by weight of at least one alkaline-reacting builder salt, from 0 to 15% by weight of a surface-active compound selected from the group consisting of anionic surface-active compounds, nonionic surface-active compounds and amphoteric surface-active compounds, and from 0 to 10% by weight of percompound stabilizers.

7. The solid oxidation compositions for use with bleaching and washing agents of claim 6 containing from 7% to 70% by weight of said activator, from 15% to 93% by weight of said builder salt and from 0% to 10% by weight of said surface-active compound.

8. Solid, powdery to granular oxidation compositions for bleaching and washing agents consisting essentially of a water-soluble solid inorganic percompound in the form of its alkali metal salt and at least one hexacyclic ester-anhydride having the formula

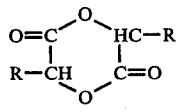

wherein R is a member selected from the group consisting of hydrogen, alkyl having 1 to 18 carbon atoms and $-(CH_2)_n-(CHOH)_m-COOY$, where n is an integer from 1 to 3, m is an integer from 0 to 1 and Y is a member selected from the group consisting of hydrogen, alkali metal, ammonium, lower alkanolammonium, and N-lower-alkyl-piperidinium, as activator, said activator being present in an amount sufficient that from 0.05 to 5 mols of said activator are present per active oxygen atoms in said percompound.

9. The solid, powdery to granular oxidation compositions for bleaching and washing agents of claim 8 wherein from 0.1 to 2 mols of said activator are present per active oxygen atoms in said percompound.

10. The solid, powdery to granular oxidation compositions for bleaching and washing agents of claim 8 wherein 0.2 to 20 mols of peroxygen are present for every 1 mol of said hexacyclic ester-anhydride.

11. The solid, powdery to granular oxidation compositions for bleaching and washing agents of claim 8 wherein 0.5 to 10 mols of peroxygen are present for every 1 mol of said hexacyclic ester-anhydride.

12. The solid, powdery to granular oxidation compositions for bleaching and washing agents of claim 8 wherein said hexacyclic ester-anhydride is present in an amount of from 0.5% to 50% by weight.

13. The solid, powdery to granular oxidation compositions for bleaching and washing agents of claim 8 wherein said hexacyclic ester-anhydride is present in an amount of from 1% to 30%.

14. The solid, powdery to granular oxidation compositions for bleaching and washing agents of claim 8 wherein R is hydrogen.

15. The solid, powdery to granular oxidation compositions for bleaching and washing agents of claim 8 wherein R is methyl.

16. The solid, powdery to granular oxidation compositions for bleaching and washing agents of claim 8, wherein up to 10% by weight of a stabilizer for percompounds is present.

* * * * *